US009117587B2

(12) United States Patent
Nagata et al.

(10) Patent No.: US 9,117,587 B2
(45) Date of Patent: Aug. 25, 2015

(54) NOISE REDUCTION DEVICE AND BUS BAR MODULE

(75) Inventors: Shuichi Nagata, Toyota (JP); Jun Mizushima, Kakegawa (JP); Akito Toyama, Toyota (JP)

(73) Assignees: TOYOTA JIDOSHA KABUSHIKI KAISHA, Toyota (JP); YAZAKI CORPORATION, Tokyo (JP)

( * ) Notice: Subject to any disclaimer, the term of this patent is extended or adjusted under 35 U.S.C. 154(b) by 0 days.

(21) Appl. No.: 13/983,629

(22) PCT Filed: Mar. 8, 2012

(86) PCT No.: PCT/IB2012/000435
§ 371 (c)(1),
(2), (4) Date: Aug. 5, 2013

(87) PCT Pub. No.: WO2012/120367
PCT Pub. Date: Sep. 13, 2012

(65) Prior Publication Data

US 2013/0342300 A1 Dec. 26, 2013

(30) Foreign Application Priority Data

Mar. 9, 2011 (JP) ..... 2011-051803

(51) Int. Cl.

| | |
|---|---|
| ***H01F 17/06*** | (2006.01) |
| ***H01F 7/06*** | (2006.01) |
| ***H01F 37/00*** | (2006.01) |
| ***H01F 41/00*** | (2006.01) |

(52) U.S. Cl.
CPC ..... *H01F 37/00* (2013.01); *H01F 17/06* (2013.01); *H01F 41/00* (2013.01); *H01F 2017/065* (2013.01); *Y10T 29/4902* (2015.01)

(58) Field of Classification Search
CPC ..... H01F 17/06; H01F 41/00; H01F 37/00; H01F 2017/065; H01F 5/06; H01F 27/33
USPC ..... 336/174–177, 212; 333/12, 185; 324/127; 174/36; 429/99; 29/602.1
See application file for complete search history.

(56) References Cited

U.S. PATENT DOCUMENTS

| | | | | |
|---|---|---|---|---|
| 3,710,006 | A * | 1/1973 | Davis | 174/101.5 |
| 4,970,476 | A * | 11/1990 | Kitagawa | 333/12 |
| 6,462,268 | B1 * | 10/2002 | Hazy et al. | 174/36 |

(Continued)

FOREIGN PATENT DOCUMENTS

| | | |
|---|---|---|
| CN | 101395737 A | 3/2009 |
| GB | 2 361 111 A | 10/2001 |

(Continued)

OTHER PUBLICATIONS

Partial Translation of Office Action issued in Japanese Application No. 2011-051803 issued Mar. 3, 2014.

*Primary Examiner* — Mangtin Lian
(74) *Attorney, Agent, or Firm* — Oliff PLC

(57) ABSTRACT

A noise reduction device includes a magnetic core and an elastically deformable elastic sheet. The magnetic core surrounds an outer periphery of an electric cable, and reduces noise emitted from the electric cable. The elastic sheet is wrapped around the electric cable so as to surround the electric cable, and is sandwiched between an inner peripheral surface of the magnetic core and an outer peripheral surface of the electric cable and elastically deformed.

10 Claims, 5 Drawing Sheets

(56) References Cited

U.S. PATENT DOCUMENTS

| | | | | |
|---|---|---|---|---|
| 2005/0285708 | A1 | 12/2005 | Berens et al. | |
| 2009/0274952 | A1* | 11/2009 | Wood et al. | 429/99 |
| 2010/0021802 | A1 | 1/2010 | Yang et al. | |

FOREIGN PATENT DOCUMENTS

| | | |
|---|---|---|
| JP | U-2-45697 | 3/1990 |
| JP | A-05-043843 | 2/1993 |
| JP | A-7-170631 | 7/1995 |
| JP | A-11-209706 | 8/1999 |
| JP | A-2001-167933 | 6/2001 |
| JP | A-2004-193316 | 7/2004 |
| JP | A-2005-011961 | 1/2005 |
| JP | A-2007-266082 | 10/2007 |
| JP | A-2008-098458 | 4/2008 |
| JP | A-2009-205865 | 9/2009 |

* cited by examiner

NOISE REDUCTION DEVICE AND BUS BAR MODULE

BACKGROUND OF THE INVENTION

1 . Field of the Invention

The invention relates to a noise reduction device that reduces noise emitted from an electric cable, and a bus bar module provided with this noise reduction device.

2 . Description of Related Art

Technology exists that reduces noise emitted from an electric cable, by attaching a magnetic core to the electric cable. Here, in Japanese Patent Application Publication No. 2005-011961 (JP 2005-011961 A), an elastic member made of gel-like resin is filled onto a surface of a magnetic core that faces an electric wire, and the magnetic core is fixed to the electric wire using the deformation force of the elastic member.

Also, in Japanese Patent Application Publication No. 2004-193316 (JP 2004-193316 A), it is possible to fix a magnetic core to an electric cable even if the diameter of the electric cable is different, by providing a member that holds the electric cable to a case of the magnetic core.

In the case of JP 2004-193316 A, the structure of the case ends up becoming complex by the provision of the member that holds the cable. In the case of JP 2005-011961 A, the shape of the elastic member must be changed according to the diameter of the electric wire that is held by the elastic member. That is, it is necessary to prepare as many elastic members in different shapes as the number of electric wires of different diameters.

SUMMARY OF THE INVENTION

A first aspect of the invention is a noise reduction device that includes a magnetic core and an elastic sheet. The magnetic core surrounds an outer periphery of an electric cable and reduces the noise emitted from the electric cable. The elastic sheet is wrapped around the electric cable so as to surround the electric cable, and is sandwiched between an inner peripheral surface of the magnetic core and an outer peripheral surface of the electric cable and elastically deformed.

A wear-resistant sheet may be arranged between the magnetic core and the elastic sheet. Using a wear-resistant sheet makes it possible to prevent the elastic sheet from wearing due to contact between the elastic sheet and the magnetic core.

At least a portion of the elastic sheet may overlap another portion of the elastic sheet when wrapping the elastic sheet around the electric cable. Accordingly, even if the relationship between the size (i.e., the diameter) of the electric cable and the magnetic core changes, the gap between the magnetic core and the electric cable can be filled with the elastic sheet. A foam, for example, may be used as the elastic sheet.

The magnetic core and the elastic sheet may surround a plurality of electric cables. When using a plurality of electric cables, the plurality of electric cables may be bundled together using an adhesive tape. An elastic sheet may be wrapped around the bundled plurality of electric cables. Bundling the plurality of electric cables together makes it easy to wrap the elastic sheet around the electric cables.

Also, using an adhesive tape makes it possible to position the plurality of electric cables in the longitudinal direction of the electric cables. For example, when a connector is provided on a tip end of each electric cable, the connectors can be positioned by positioning the plurality of electric cables. As a result, the connectors can be arranged in a predetermined connecting position, so that the connectors can be connected easily.

A second aspect of the invention relates to a bus bar module that includes a plurality of bus bars, a holder, and an electric cable. The plurality of bus bars are used to electrically connect a plurality of power storage elements together. The holder holds the plurality of bus bars and is made of insulating material, such as resin. One end of the electric cable is fixed to the holder and a portion of the electric cable on the other end side is drawn out of the holder. The noise reduction device according to the first aspect described above may be used in this kind of bus bar module.

In this bus bar module, when a plurality of electric cables are used, a guide portion that guides the plurality of electric cables to an attaching position of the noise reduction device may be provided on the holder. Using the guide portion makes it possible to gather the plurality of electric cables together in one place, so that the noise reduction device can easily be attached to the plurality of electric cables.

A third aspect of the invention relates to a manufacturing method for a noise reduction device that has a magnetic core that surrounds an electric cable. This manufacturing method includes wrapping an elastically deformable elastic sheet around the electric cable so that the elastic sheet surrounds the electric cable; and elastically deforming the elastic sheet by attaching the magnetic core to the electric cable that is surrounded by the elastic sheet.

In wrapping the elastic sheet around the electric cable, a wrapped state of the elastic sheet with respect to the electric cable may be changed according to a diameter of the electric cable and an inside diameter of the magnetic core. The wrapped state of the elastic sheet includes, for example, a state in which the elastic sheet is wrapped around the outer periphery of the electric cable only once, and a state in which the elastic sheet is wrapped around the outer periphery of the electric cable a plurality of times.

According to the invention, the restoring force of the elastically deformed elastic sheet makes it possible to fix the magnetic core to the electric cable and inhibit the magnetic core from slipping with respect to the electric cable. In addition, the elastic sheet is wrapped around the electric cable, and therefore, even when an electric cable having a different diameter is used, the magnetic core can be fixed to the electric cable simply by changing the wrapped state of the elastic sheet.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENT

Hereinafter, example embodiments of the invention will be described.

Figure 1:
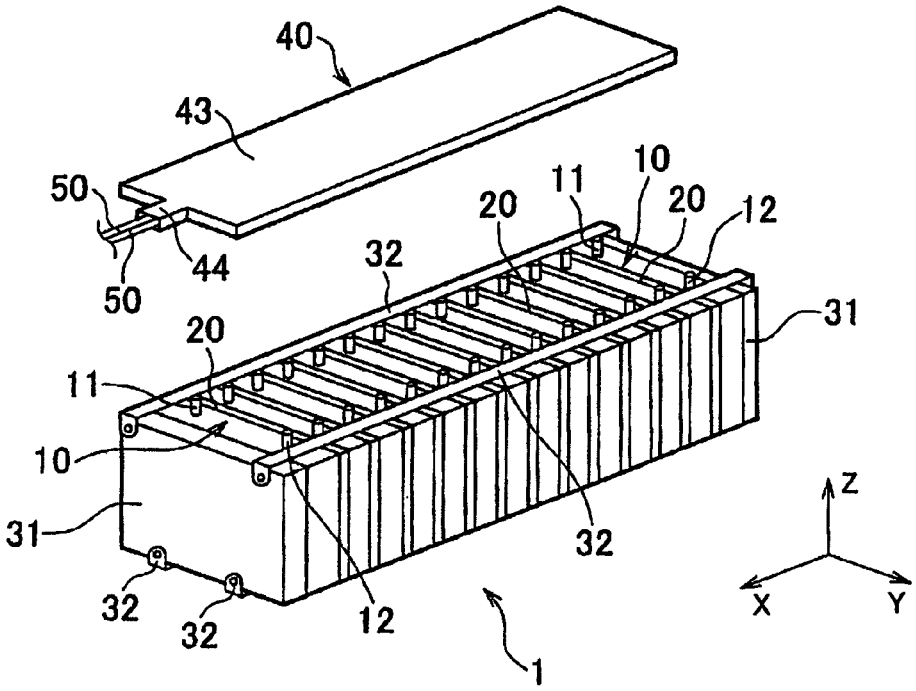
FIG. 1 is an external view of a cell stack according to an example embodiment of the invention.

A cell stack according to one example embodiment of the invention will now be described. FIG. 1 is an external view of a cell stack according to this example embodiment. In FIG. 1, the X axis, the Y axis, and the Z axis are all orthogonal to one another. In this example embodiment, the axis corresponding to the vertical direction is the Z axis. The relationships between the X axis, the Y axis, and the Z axis are the same for the other drawings as well.

A cell stack 1 shown in FIG. 1 is housed in a pack case (not shown). The cell stack 1 and the pack case together form a battery pack. The battery pack is able to be mounted in a vehicle, for example. By converting electric energy output from the battery pack to kinetic energy using a motor-generator, the vehicle can be made to run using this kinetic energy. When the vehicle is stopped or decelerated, by converting kinetic energy generated when braking the vehicle into electric energy using a motor-generator, this electric energy can be stored in the battery pack.

The cell stack 1 has a plurality of single cells (power storage elements) 10 lined up in the X direction. Secondary batteries such as nickel-metal hydride batteries or lithium ion batteries may be used as the single cells 10. Also, electric double layer capacitors (capacitors) may be used instead of secondary batteries. The number of single cells 10 may be set appropriately based on the required output and the like of the cell stack 1.

In this example embodiment, the plurality of single cells 10 are lined up in the X direction, but the invention is not limited to this. More specifically, a plurality of single cells may be used to form a single battery module, and a plurality of battery modules may be lined up in the X direction.

A positive terminal 11 and a negative terminal 12 are provided on an upper surface of each single cell 10. The positive terminal 11 and the negative terminal 12 are electrically connected to a power generating element housed inside the single cell 10. The power generating element is an element that charges and discharges, and may be formed of, for example, a positive plate, a negative plate, and a separator (including an electrolyte solution) arranged between the positive plate and the negative plate. The positive terminal 11 is electrically connected to the positive plate of the power generating element, and the negative terminal 12 is electrically connected to the negative plate of the power generating element.

A spacer 20 is provided between two adjacent single cells 10 in the X direction. The spacer 20 may be made of resin, for example. The spacer 20 is used to form a space on the surfaces of the single cells 10, and this space becomes a movement passage for a heat exchange medium that is used to regulate the temperature of the single cells 10.

When the single cells 10 are generating heat, an increase in the temperature of the single cells 10 is suppressed by flowing a heat exchange medium for cooling through the space formed between the spacer 20 and the single cells 10. When the single cells 10 are excessively cooled, a decrease in the temperature of the single cells 10 is suppressed by flowing a heat exchange medium for heating through the space formed between the spacer 20 and the single cells 10.

In this example embodiment, the spacer 20 is provided, but this spacer 20 may also be omitted.

A pair of end plates 31 are arranged one on each end of the cell stack 1 in the X direction. A restraining band 32 extends in the X direction, with one end of the restraining band 32 being fixed to one end plate 31 and the other end of the restraining band 32 being fixed to the other end plate 31. By fixing the ends of the restraining band 32 to the pair of end plates 31, restraining force is applied to the plurality of single cells 10 sandwiched between the pair of end plates 31.

The restraining force is force that squeezes the single cells 10 together in the X direction. Applying restraining force to the single cells 10 suppresses expansion of the single cells 10 and the like, and suppresses a deterioration of the input/output characteristics of the single cells 10.

Two of the restraining bands 32 are arranged on the upper surface of the cell stack 1, and two of the restraining bands 32 are arranged on the lower surface of the cell stack 1. The positions in which the restraining bands 32 are arranged may be set appropriately. For example, the restraining bands 32 may be arranged on both side surfaces of the cell stack 1 in the Y direction.

A bus bar module 40 includes a plurality of bus bars, and a holder 43 that holds the plurality of bus bars. In FIG. 1, only the outside of the holder 43 is shown as the bus bar module 40. The illustration of the plurality of bus bars is omitted.

The holder of the bus bar module 40 is made of insulating material such as resin. Each bus bar is connected to the positive terminal 11 of one single cell 10 and the negative terminal 12 of another single cell 10, of two adjacent single cells 10 in the X direction. Therefore, the plurality of single cells 10 that form the cell stack 1 are electrically connected in series by the plurality of bus bars.

Next, the structure of the bus bar module 40 will be described.

Figure 2:
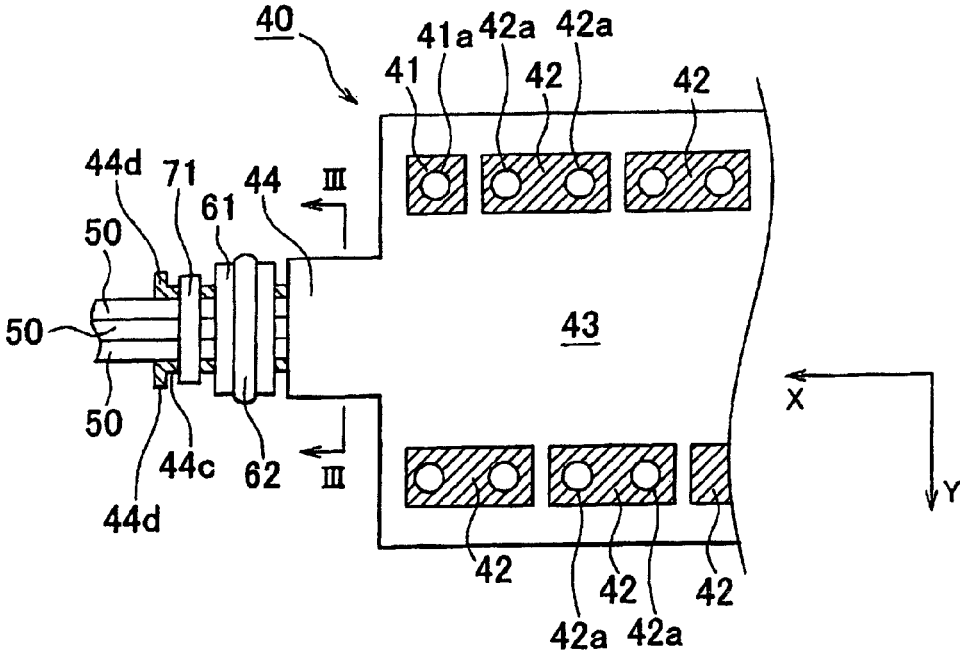
FIG. 2 is a plan view of a portion of a bus bar module according to the example embodiment.

FIG. 2 is a plan view of a portion of the bus bar module 40. As shown in FIG. 2, the bus bar module 40 includes bus bars 41 and 42. The bus bar 41 is connected to an electrode terminal (such as the positive terminal 11) of a single cell 10 positioned at one end of the cell stack 1 in the X direction. The bus bar 41 has an opening 41*a* through which the electrode terminal of the single cell 10 is passed. The positive terminal 11 of the single cell 10 that is connected to the bus bar 41 becomes a positive terminal of the cell stack 1, and the bus bar 41 is connected to a high-voltage cable for charging and discharging the cell stack 1.

Although not shown in FIG. 2, a bus bar corresponding to the bus bar 41 is also connected to an electrode terminal (such as the negative terminal 12) of a single cell 10 that is positioned at the other end of the cell stack 1 in the X direction. The negative terminal 12 of the single cell 10 that is connected to this bus bar becomes a negative terminal of the cell stack 1, and the bus bar is connected to a high-voltage cable for charging and discharging the cell stack 1. The two high-voltage cables that are connected to the positive terminal and negative terminal of the cell stack 1 are electrically connected to a load (such as the motor-generator described above).

The bus bar 42 electrically connects the positive terminal 11 of one single cell 10 to the negative terminal 12 of another single cell 10, of two adjacent single cells 10 in the X direction. The bus bar 42 has two openings 42*a*, through which the positive terminal 11 and the negative terminal 12 are individually passed.

The holder 43 is made of insulating material such as resin, and holds the bus bars 41 and 42. A guide portion 44 is provided on one end of the holder 43 in the X direction. This guide portion 44 is used to bring three electric cables 50 that are fixed to the holder 43 together in one place.

The electric cables 50 may be, for example, a wire harness for transmitting output signals from a temperature sensor to a controller, a wire harness for connecting a current sensor and the cell stack 1, and a wire harness for connecting a voltage sensor and the cell stack 1.

The temperature sensor is used to detect the temperature of the cell stack 1, and may be arranged in one or a plurality of locations on the cell stack 1. A thermistor, for example, may be used as the temperature sensor. The current sensor is used to detect a current value flowing through the cell stack 1 when charging or discharging. The voltage sensor is used to detect a voltage value of the cell stack 1 or the single cells 10. Here, when two or more single cells 10 form one block and the cell stack 1 is divided into a plurality of blocks, the voltage value of each block can be detected by the voltage sensor.

In this example embodiment, three electric cables 50 are arranged, but the invention is not limited to this. That is, the number of electric cables 50 may be set appropriately. The electric cables 50 are not limited to the wire harnesses described above, as long as they are electric cables 50 that are used to transmit specific electric signals.

Figure 3:
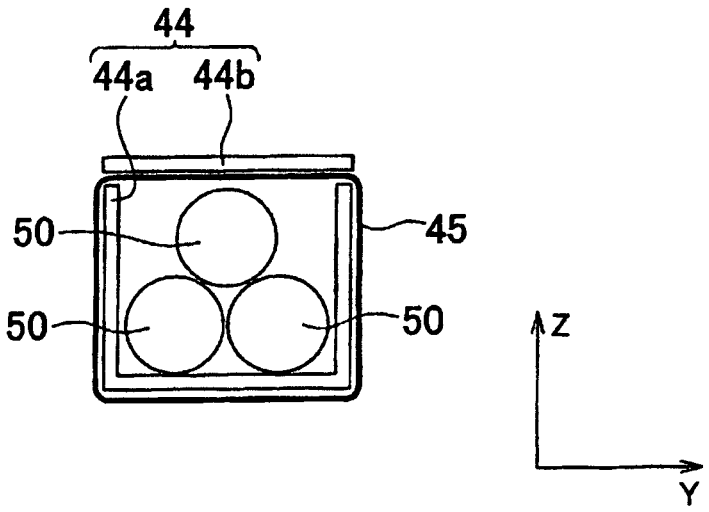
FIG. 3 is a sectional view taken along line III-III in FIG. 2.

FIG. 3 is a sectional view taken along line III-III in FIG. 2. As shown in FIG. 3, the three electric cables 50 are housed inside the guide portion 44. The guide portion 44 includes a first guide portion 44*a* and a second guide portion 44*b* . The first guide portion 44*a* is formed of three walls, and the three electric cables 50 are arranged inside the first guide portion 44*a*.

Adhesive tape 45 is wrapped around the outer periphery of the first guide portion 44*a* , in which the three electric cables 50 are housed. The adhesive tape 45 prevents the electric cables 50 from coming out of the first guide portion 44*a* . The second guide portion 44*b* is arranged above the first guide portion 44*a*.

The guide portion 44 also includes a third guide portion 44*c* that protrudes from the first guide portion 44*a* in the X direction. The three electric cables 50 are arranged along an upper surface of the third guide portion 44*c* . A stopper 44*d* that extends in the Y direction is provided on a tip end of the third guide portion 44*c*.

Figure 4:
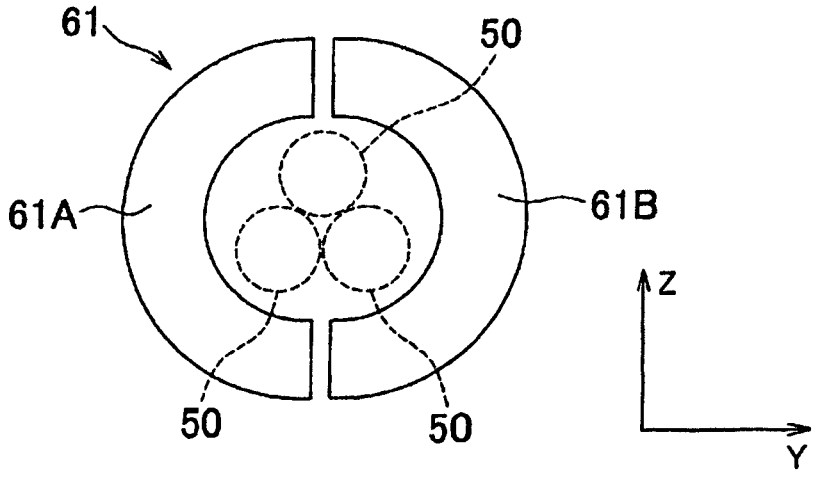
FIG. 4 is a diagram of a structure of a magnetic core according to the example embodiment.

As shown in FIG. 2, a magnetic core 61 is fixed to the electric cables 50 that are drawn out of the first guide portion 44*a* . The magnetic core 61 surrounds the three electric cables 50. The magnetic core 61 reduces noise emitted from the electric cables 50. As shown in FIG. 4, the magnetic core 61 is divided into two halves, i.e., a magnetic core 61A and a magnetic core 61B, and these two halves, the magnetic core 61A and the magnetic core 61B, sandwich the three electric cables 50. A surface of the magnetic core 61 that faces the electric cables 50 is a curved surface. An outer surface of the magnetic core 61 is also a curved surface.

Figure 5:
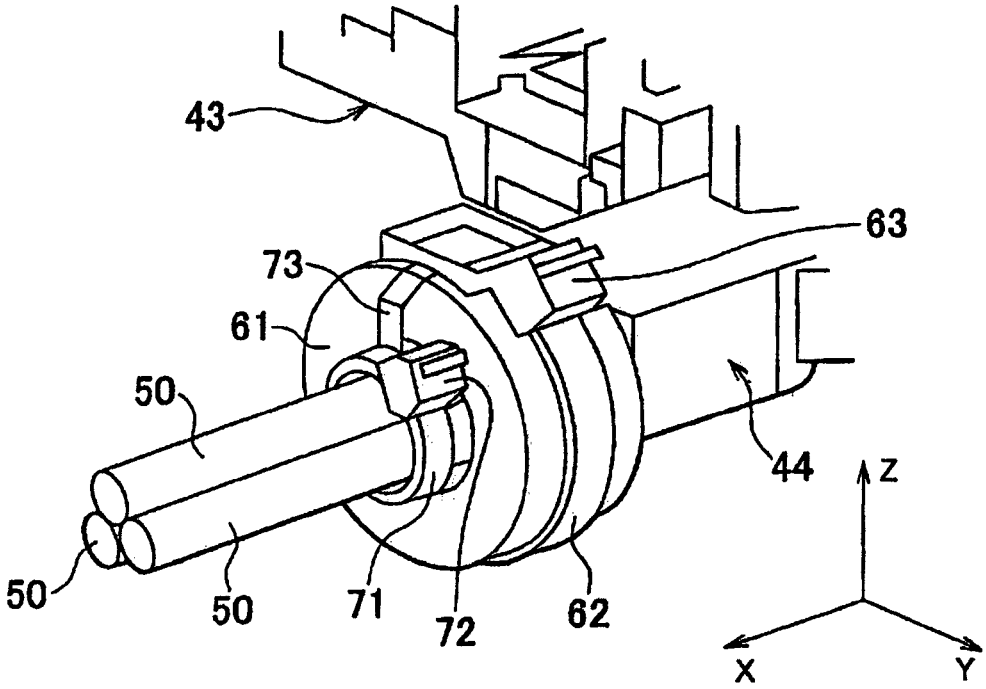
FIG. 5 is a diagram of a structure around the magnetic core according to the example embodiment.

A first banding band 62 is arranged along the outer periphery of the magnetic core 61 and is used to fix the two magnetic core halves 61A and 61B together. As shown in FIG. 5, a first fastener 63 is provided on the first banding band 62. The first fastener 63 is able to change the positions of both ends of the first banding band 62.

The first banding band 62 can be tightened or loosened with respect to the magnetic core 61 by operating the first fastener 63. It is sufficient that the first fastener 63 be able to tighten and loosen the first banding band 62. A known structure may be used as appropriate for the structure of the first fastener 63.

As shown in FIG. 5, a second banding band 71 is wrapped around the three electric cables 50 drawn out of the magnetic core 61. More specifically, the second banding band 71 surrounds the three electric cables 50 and the third guide portion 44*c* . A second fastener 72 is provided on the second banding band 71. The second fastener 72 is able to change the positions of both ends of the second banding band 71.

The second banding band 71 can be tightened or loosened with respect to the electric cables 50 by operating the second fastener 72. It is sufficient that the second fastener 72 be able to tighten and loosen the second banding band 71. A known structure may be used as appropriate for the structure of the second fastener 72.

The second banding band 71 is arranged next to the magnetic core 61 in the longitudinal direction of the electric cables 50. When the magnetic core 61 is displaced in the direction along the electric cables 50, the magnetic core 61 will contact the second banding band 71. In this way, the second banding band 71 is able to prevent the magnetic core 61 from coming out of the first banding band 62.

In this example embodiment, a connecting band 73 is connected to the first banding band 62 and the second banding band 71, so that the first banding band 62 and the second banding band 71 can be treated as a single unit. The first banding band 62 and the second banding band 71 may also be used in a separated state.

As shown in FIG. 2, the stopper 44*d* is formed on the tip end of the third guide portion 44*c* , so when the second banding band 71 moves in the X direction, the second banding band 71 will contact the stopper 44*d* . In this way, the stopper 44*d* is able to prevent the second banding band 71 from moving more than an allowed amount.

Next, the structure arranged inside the magnetic core 61 will be described.

Figure 6:
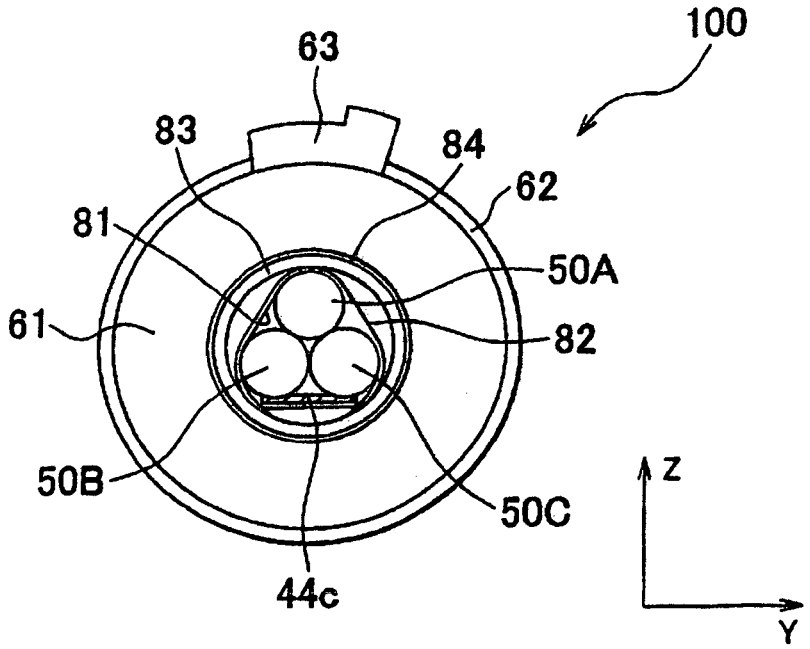
FIG. 6 is a diagram of a structure arranged inside the magnetic core according to the example embodiment.
Figure 7:
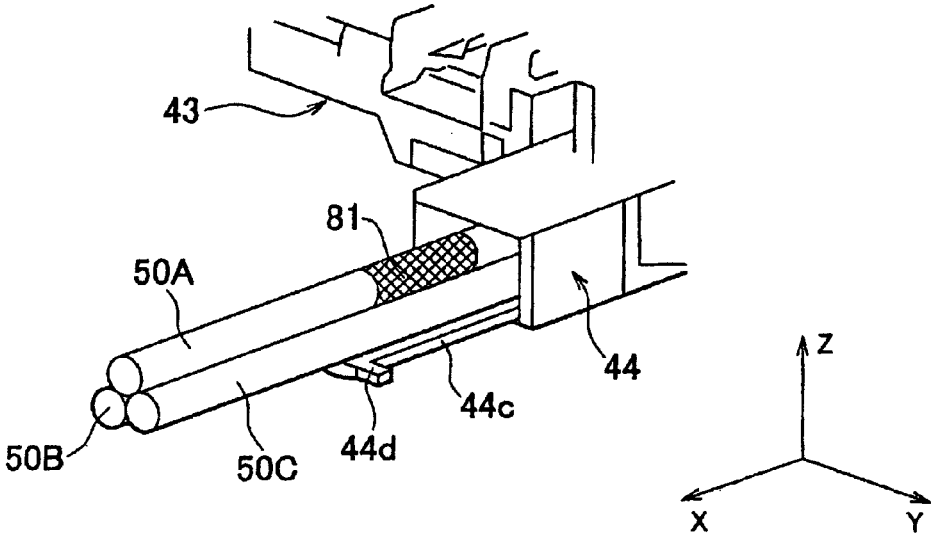
FIG. 7 is a diagram of an arrangement of an electric cable according to the example embodiment.

FIG. 6 is a diagram of a noise reduction device 100 according to the example embodiment, and is a sectional view in the Y and Z directions of a portion including the magnetic core 61, showing the structure arranged inside the magnetic core 61. An adhesive tape 81 is wrapped around two electric cables 50A and 50B, of three electric cables 50A to 50C shown in FIG. 6. FIG. 7 is a diagram showing the adhesive tape 81 wrapped around the electric cables 50A and 50B. By wrapping the adhesive tape 81 around the electric cables 50A and 50B, the electric cables 50A and 50B are bundled together. In this example embodiment, the adhesive tape 81 is used to make it easier to handle the electric cables 50A and 50B, but the adhesive tape 81 may also be omitted.

An adhesive tape 82 is wrapped around the three electric cables 50A to 50C and the third guide portion 44*c* . With the use of the adhesive tape 82, it is made possible to bundle the electric cables 50A to 50C together, and fix the electric cables 50A to 50C to the third guide portion 44*c*.

In addition, with the use of the adhesive tape 82, it is also made possible to position the three electric cables 50A to 50C in the longitudinal direction of the electric cables 50A to 50C. When a connector is provided at the tip end of each of the electric cables 50A to 50C, the connectors must be arranged in a predetermined connecting position. In this case, using the adhesive tape 82 to position the electric cables 50A to 50C makes it easier to arrange the connectors in the predetermined connecting position.

In this example embodiment, the adhesive tape 82 is used to make it easier to handle the electric cables 50A to 50C, but the adhesive tape 82 may also be omitted.

Figure 8:
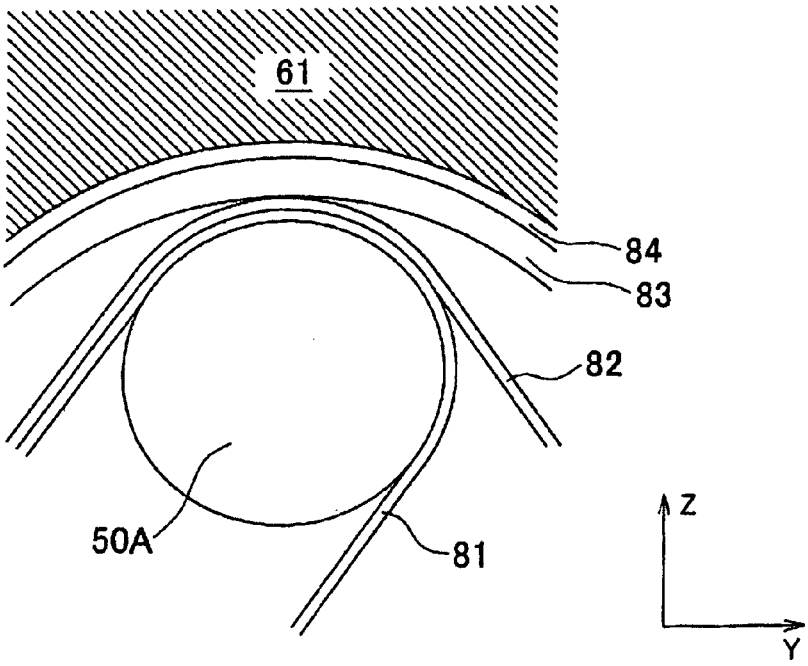
FIG. 8 is an enlarged view of a portion of a structure arranged inside the magnetic core according to the example embodiment.
Figure 9:
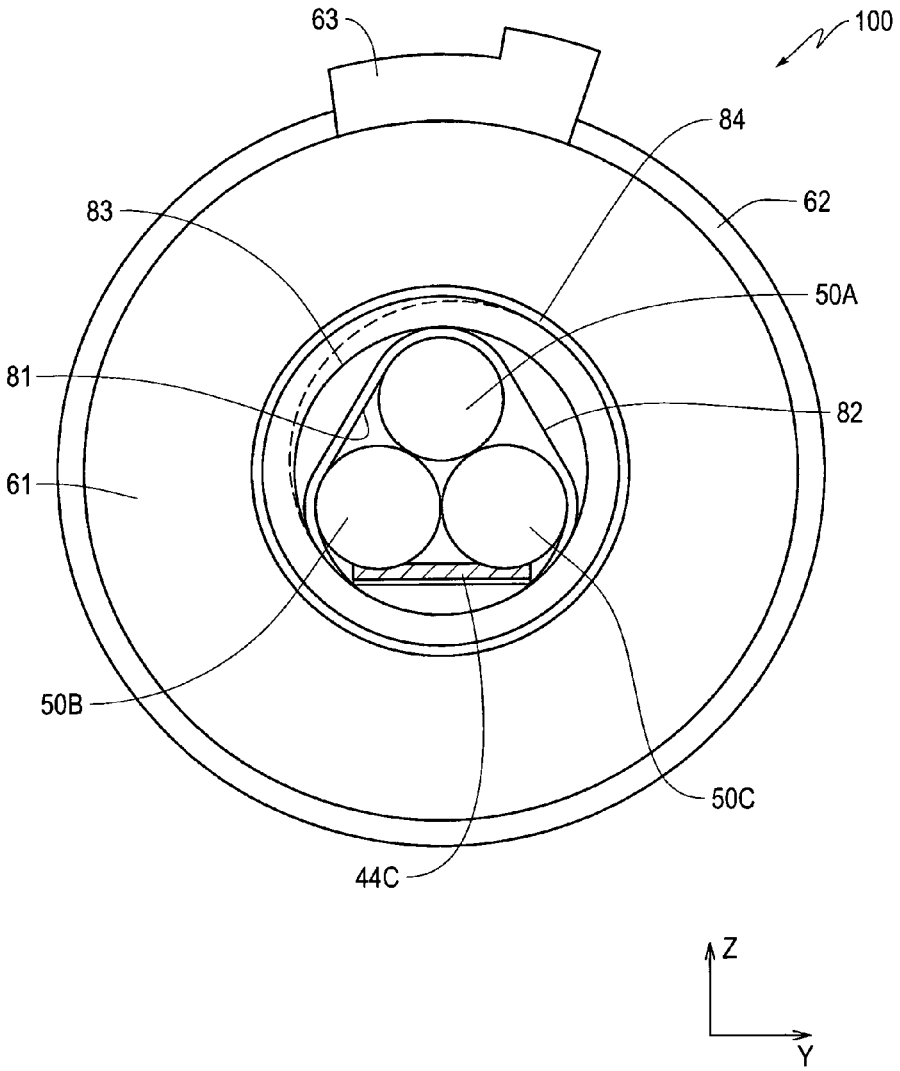
FIG. 9 is an enlarged view of the structure illustrated in FIG. 6.

A long elastic sheet 83 is wrapped around the outer periphery of the adhesive tape 82. FIG. 8 is an enlarged view of a portion of the structure inside of the magnetic core 61. The elastic sheet 83 is a sheet that elastically deforms. EPT sealer (registered trademark) made by Nitto Denko Corporation, for example, may be used as the elastic sheet 83. EPT sealer is a foam and is able to elastically deform. The elastic sheet 83 is in contact with the outer peripheral surface (a portion thereof) of the adhesive tape 82, and surrounds the three electric cables 50A to 50C and the third guide portion 44*c*.

In this example embodiment, the elastic sheet 83 is wrapped so as to go all the way around the outer periphery of the adhesive tape 82. In other words, the elastic sheet 83 is wrapped so that one end portion of the elastic sheet 83 in the longitudinal direction is in contact with the other end portion of the elastic sheet 83 in the longitudinal direction. The elastic sheet 83 may be wrapped so that at least a portion of the elastic sheet 83 overlaps another portion of the elastic sheet 83. The greater the number of times the elastic sheet 83 is wrapped around, the thicker the portion where the elastic sheet 83 overlaps becomes.

The way in which the elastic sheet 83 is wrapped may be set appropriately, taking into account the inside diameter of the magnetic core 61 and the arranging space of the electric cables 50A to 50C that are positioned inside the magnetic core 61 (i.e., the space that the electric cables 50A to 50C take up inside the magnetic core (61)). For example, when the arranging space of the electric cables 50A to 50C is equal to the space corresponding to the inside diameter of the magnetic core 61, the elastic sheet 83 may be wrapped around only once. On the other hand, when the arranging space of the electric cables 50A to 50C is smaller than the space corresponding to the inside diameter of the magnetic core 61, the elastic sheet 83 may be wrapped around a plurality of times.

In this example embodiment, the three electric cables 50A to 50C are used, but when only one electric cable 50 is used, for example, the way in which the elastic sheet 83 is wrapped may be set appropriately, taking into account the diameter of the electric cable 50 and the inside diameter of the magnetic core 61. If the difference between the diameter of the electric cable 50 and the inside diameter of the magnetic core 61 is small, the elastic sheet 83 may be wrapped around only once. On the other hand, if the difference between the diameter of the electric cable 50 and the inside diameter of the magnetic core 61 is large, the elastic sheet 83 may be wrapped around a plurality of times.

The elastic sheet 83 elastically deforms when it is assembled inside the magnetic core 61. In other words, the elastic sheet 83 is wrapped such that the wrapped elastic sheet 83 is pressed by the magnetic core 61 so that it elastically deforms.

When the elastic sheet 83 is elastically deformed, the restoring force of the elastic sheet 83 is applied to the magnetic core 61 and the electric cables 50A to 50C. As a result, it is possible to attach the magnetic core 61 to the electric cables 50A to 50C so that it will not slip. More specifically, using the elastic sheet 83 makes it possible to inhibit the magnetic core 61 from sliding in the longitudinal direction of the electric cables 50A to 50C, and inhibit the magnetic core 61 from rotating around the electric cables 50A to 50C.

Inhibiting the magnetic core 61 from sliding with respect to the electric cables 50A to 50C makes it possible to prevent the noise reduction effect of the magnetic core 61 from changing. That is, the noise reduction effect of the magnetic core 61 is made stable.

According to the example embodiment, even if the arranging space of the electric cables changes with respect to the space formed inside the magnetic core 61, all that need be done is to simply change the way in which the elastic sheet 83 is wrapped. That is, when the magnetic core 61 having a certain inside diameter is attached on different electric cables 50 having different diameters, the magnetic core 61 can be fixed to the electric cable 50 simply by changing the way in which the elastic sheet 83 is wrapped. In this example embodiment, all that need be done is to change the way that the elastic sheet 83 is wrapped, and therefore, there is no need to change the elastic sheet 83 depending on electric cables 50 with different diameters.

Further, the elastic sheet 83 is arranged between the magnetic core 61 and the electric cables 50A to 50C, so that the magnetic core 61 is prevented from contacting the electric cables 50A to 50C. As a result, the magnetic core 61 is prevented from damaging the outer surfaces of the electric cables 50A to 50C.

A highly wear-resistant sheet 84 is wrapped around the outer peripheral surface of the elastic sheet 83. Here, the sheet 84 is wrapped so as to allow the elastic sheet 83 to elastically deform. More specifically, the sheet 84 is wrapped such that the elastic sheet 83 is in its natural state. If the elastic sheet 83 is constricted when the sheet 84 is wrapped around it, it would be more difficult to apply the restoring force of the elastic sheet 83 to the magnetic core 61 and the electric cables 50A to 50C, and it would therefore become more difficult to fix the magnetic core 61 to the electric cables 50A to 50C.

The sheet 84 is positioned between the elastic sheet 83 and the magnetic core 61, so that the sheet 84 is in contact with the outer peripheral surface of the elastic sheet 83 and the inner peripheral surface of the magnetic core 61. Tesa tape made by tesa tape, inc., for example, may be used as the sheet 84.

Arranging the wear-resistant sheet 84 on the inner peripheral surface of the magnetic core 61 prevents the magnetic core 61 from contacting the outer peripheral surfaces of the electric cables 50A to 50C and the elastic sheet 83, and thus prevents the electric cables 50A to 50C and the elastic sheet 83 from becoming damaged.

The invention has been described with reference to example embodiments for illustrative purposes only. It should be understood that the description is not intended to be exhaustive or to limit form of the invention and that the invention may be adapted for use in other systems and applications. The scope of the invention embraces various modifications and equivalent arrangements that may be conceived by one skilled in the art.

The invention claimed is:

1. A noise reduction device for use with a bus bar module having a holder, the noise reduction device comprising:

a magnetic core configured to surround an outer periphery of an electric cable;

an elastic sheet configured to wrap around the electric cable so as to surround the electric cable, the elastic sheet being disposed between an inner peripheral surface of the magnetic core and an outer peripheral surface of the electric cable and elastically deformed, and at least a first portion of the elastic sheet overlaps a second portion of the elastic sheet; and a guide portion of the holder disposed between the elastic sheet and the electric cable.

2. The noise reduction device according to claim 1, further comprising:

a wear-resistant sheet that is arranged between the magnetic core and the elastic sheet.

3. The noise reduction device according to claim 1, wherein the magnetic core and the elastic sheet surround a plurality of the electric cables.

4. The noise reduction device according to claim 3, further comprising: an adhesive tape that bands the plurality of electric cables together.

5. The noise reduction device according to claim 1, wherein the elastic sheet is formed of a foam material.

6. A bus bar module comprising:

a plurality of bus bars for electrically connecting a plurality of power storage elements together;

a holder that holds the plurality of bus bars and is made of insulating material;

an electric cable, one end of which is fixed to the holder and a portion on the other end side of which is drawn out of the holder; and the noise reduction device according to claim 1.

7. The bus bar module according to claim 6, further comprising a plurality of the electric cables, wherein the guide portion is configured to guide the plurality of electric cables to an attaching position of the noise reduction device.

8. A manufacturing method for a noise reduction device for use with a bus bar module having a holder, the noise reduction device including a magnetic core configured to surround an electric cable, the method comprising:

providing the electric cable and a holder having a guide portion;

wrapping an elastically deformable elastic sheet around the electric cable and the guide portion so that the elastic sheet surrounds the electric cable and the guide portion, the elastic sheet having a first portion and a second portion where the first portion overlaps the second portion; and elastically deforming the elastic sheet by attaching the magnetic core to the electric cable that is surrounded by the elastic sheet.

9. The manufacturing method for a noise reduction device according to claim 8, wherein in wrapping the elastic sheet around the electric cable, a wrapped state of the elastic sheet with respect to the electric cable is changed according to a diameter of the electric cable and an inside diameter of the magnetic core.

10. The noise reduction device according to claim 1, wherein a number of times the elastic sheet is wrapped around the electric cable is changed according to a diameter of the electric cable and an inside diameter of the magnetic core.

* * * * *